US011487233B2

(12) United States Patent
Mochizuki

(10) Patent No.: US 11,487,233 B2
(45) Date of Patent: Nov. 1, 2022

(54) IMAGE FORMING APPARATUS FOR REGULATING REMOVAL OF DEVELOPER STORING PORTION, AND REGULATION RELEASING METHOD

(71) Applicant: KYOCERA Document Solutions Inc., Osaka (JP)

(72) Inventor: Masayuki Mochizuki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/461,685

(22) Filed: Aug. 30, 2021

(65) Prior Publication Data

US 2022/0066374 A1 Mar. 3, 2022

(30) Foreign Application Priority Data

Aug. 31, 2020 (JP) ..... JP2020-145975

(51) Int. Cl.
*G03G 15/00* (2006.01)
*G03G 21/16* (2006.01)
*G03G 15/08* (2006.01)

(52) U.S. Cl.
CPC ..... *G03G 15/556* (2013.01); *G03G 15/0856* (2013.01); *G03G 15/5091* (2013.01); *G03G 21/1633* (2013.01)

(58) Field of Classification Search
CPC .... G03G 15/509; G03G 15/55; G03G 15/553; G03G 21/1623; G03G 21/1633
See application file for complete search history.

(56) References Cited

U.S. PATENT DOCUMENTS 6,275,664 B1 * 8/2001 Wolf ..... B41J 2/17566 399/23
2016/0223930 A1 * 8/2016 Harada ..... G03G 15/01
2017/0315470 A1 * 11/2017 Mochizuki ..... G03G 21/1638
2017/0315501 A1 * 11/2017 Mochizuki ..... G03G 15/556
2017/0315502 A1 * 11/2017 Mochizuki ..... G03G 15/55
2019/0056689 A1 * 2/2019 Chou ..... G03G 15/0856
2022/0035294 A1 * 2/2022 Miyazaki ..... G03G 15/556

FOREIGN PATENT DOCUMENTS

JP H11109752 A 4/1999

* cited by examiner

*Primary Examiner* — Carla J Therrien
(74) *Attorney, Agent, or Firm* — Alleman Hall Creasman & Tuttle LLP

(57) ABSTRACT

An image forming apparatus includes an image forming portion, a supply processing portion, and a second release processing portion. The image forming portion includes a storing portion that stores developer, and forms an image by using the developer stored in the storing portion. The supply processing portion supplies the developer to the storing portion from a developer storing portion attached to an attachment portion, when a storage amount of the developer in the storing portion is less than or equal to a first threshold. The second release processing portion releases regulation on a removal of the developer storing portion when an expected amount of developer to be used by a user is greater than or equal to a reference value that is determined based on a remaining amount of the developer in the developer storing portion attached to the attachment portion.

6 Claims, 9 Drawing Sheets

IMAGE FORMING APPARATUS FOR REGULATING REMOVAL OF DEVELOPER STORING PORTION, AND REGULATION RELEASING METHOD

INCORPORATION BY REFERENCE

This application is based upon and claims the benefit of priority from the corresponding Japanese Patent Application No. 2020-145975 filed on Aug. 31, 2020, the entire contents of which are incorporated herein by reference.

BACKGROUND

The present disclosure relates to an image forming apparatus, and a regulation releasing method to be executed in the image forming apparatus.

Conventionally known is an image forming apparatus including a regulation portion capable of regulating removal of a developer storing portion, such as a toner container storing developer such as toner, from an attachment portion to which the developer storing portion has been attached.

For example, in this type of image forming apparatus, when a storage amount of the developer in a development portion for developing an electrostatic latent image by using the developer is less than or equal to a predetermined first threshold, the developer is supplied to the development portion from the developer storing portion attached to the attachment portion. In addition, the storage amount of the developer in the development portion is less than or equal to a second threshold, which is lower than the first threshold, a printing operation is restricted, and then regulation on the removal of the developer storing portion imposed by the regulation portion is released. This reduces a remaining amount of the developer inside the developer storing portion at a time of replacing the developer storing portion.

SUMMARY

An image forming apparatus according to one aspect of the present disclosure includes an attachment portion, a regulation portion, an image forming portion, a supply processing portion, a first release processing portion, an acquisition processing portion, and a second release processing portion. A developer storing portion that stores developer is attached to the attachment portion. The regulation portion regulates a removal of the developer storing portion attached to the attachment portion from the attachment portion. The image forming portion includes a storing portion that stores the developer, and forms an image by using the developer stored in the storing portion. When a storage amount of the developer in the storing portion is less than or equal to a predetermined first threshold, the supply processing portion supplies the developer to the storing portion from the developer storing portion attached to the attachment portion. When the storage amount of the developer in the storing portion is less than or equal to a second threshold, which is lower than the first threshold, the first release processing portion restricts operation of the image forming portion and releases regulation on the removal of the developer storing portion imposed by the regulation portion. The acquisition processing portion acquires an expected amount of developer to be used by a user. When the expected amount of developer to be used acquired by the acquisition processing portion is greater than or equal to a predetermined reference value that is determined based on a remaining amount of the developer in the developer storing portion attached to the attachment portion, the second release processing portion releases regulation on the removal of the developer storing portion imposed by the regulation portion.

A regulation releasing method according to another aspect of the present disclosure is executed in an image forming apparatus including an attachment portion to which a developer storing portion that stores developer is attached, a regulation portion that regulates a removal of the developer storing portion attached to the attachment portion from the attachment portion, and an image forming portion including a storing portion that stores the developer, the image forming portion configured to form an image by using the developer stored in the storing portion. The regulation releasing method includes a supplying step, a first releasing step, an acquisition step, and a second releasing step. In the supplying step, when a storage amount of the developer in the storing portion is less than or equal to a predetermined first threshold, the developer is supplied to the storing portion from the developer storing portion attached to the attachment portion. In the first releasing step, when the storage amount of the developer in the storing portion is less than or equal to a second threshold, which is lower than the first threshold, operation of the image forming portion is restricted, and regulation on the removal of the developer storing portion imposed by the regulation portion is released. In the acquisition step, an expected amount of developer to be used by a user is acquired. In the second releasing step, when the expected amount of developer to be used by the user acquired by the acquisition step is greater than or equal to a predetermined reference value that is determined based on a remaining amount of the developer in the developer storing portion attached to the attachment portion, regulation on the removal of the developer storing portion imposed by the regulation portion is released.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 100]

Firstly, a configuration of an image forming apparatus 100 according to an embodiment of the present disclosure will be described with reference to FIG. 1 and FIG. 2. Here, FIG. 2 is a perspective view showing an appearance of the image forming apparatus 100. FIG. 2 shows the image forming apparatus 100 in a state where an ADF 1 is removed.

For convenience of the explanation, the vertical direction in an installation state where the image forming apparatus 100 is installed in a usable manner (the state shown in FIG. 2) is defined as an up-down direction D1. In addition, a front-rear direction D2 is defined on the supposition that a front right side surface of the image forming apparatus 100 shown in FIG. 2 is a front (front surface). In addition, a left-right direction D3 is defined with reference to the front of the image forming apparatus 100 in the installation state.

The image forming apparatus 100 is a multifunction peripheral having multiple functions such as a scan function that reads an image of a document sheet, a print function that forms an image based on an image data, a facsimile function and a copy function, etc. The image forming apparatus 100 may be a printer device, a facsimile apparatus, or a copier.

Figure 1:
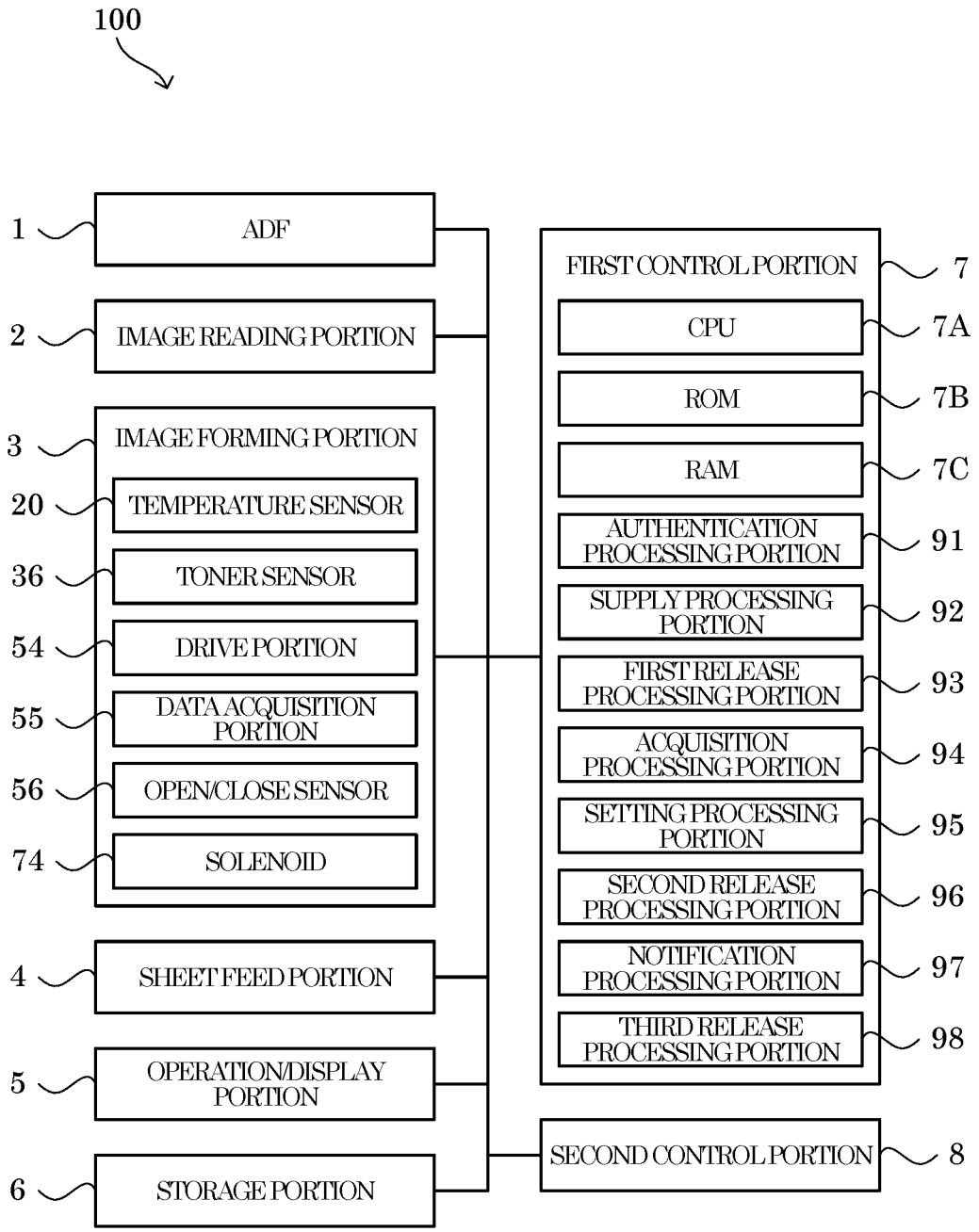
FIG. 1 is a block diagram showing a system configuration of an image forming apparatus according to an embodiment of the present disclosure.
Figure 2:
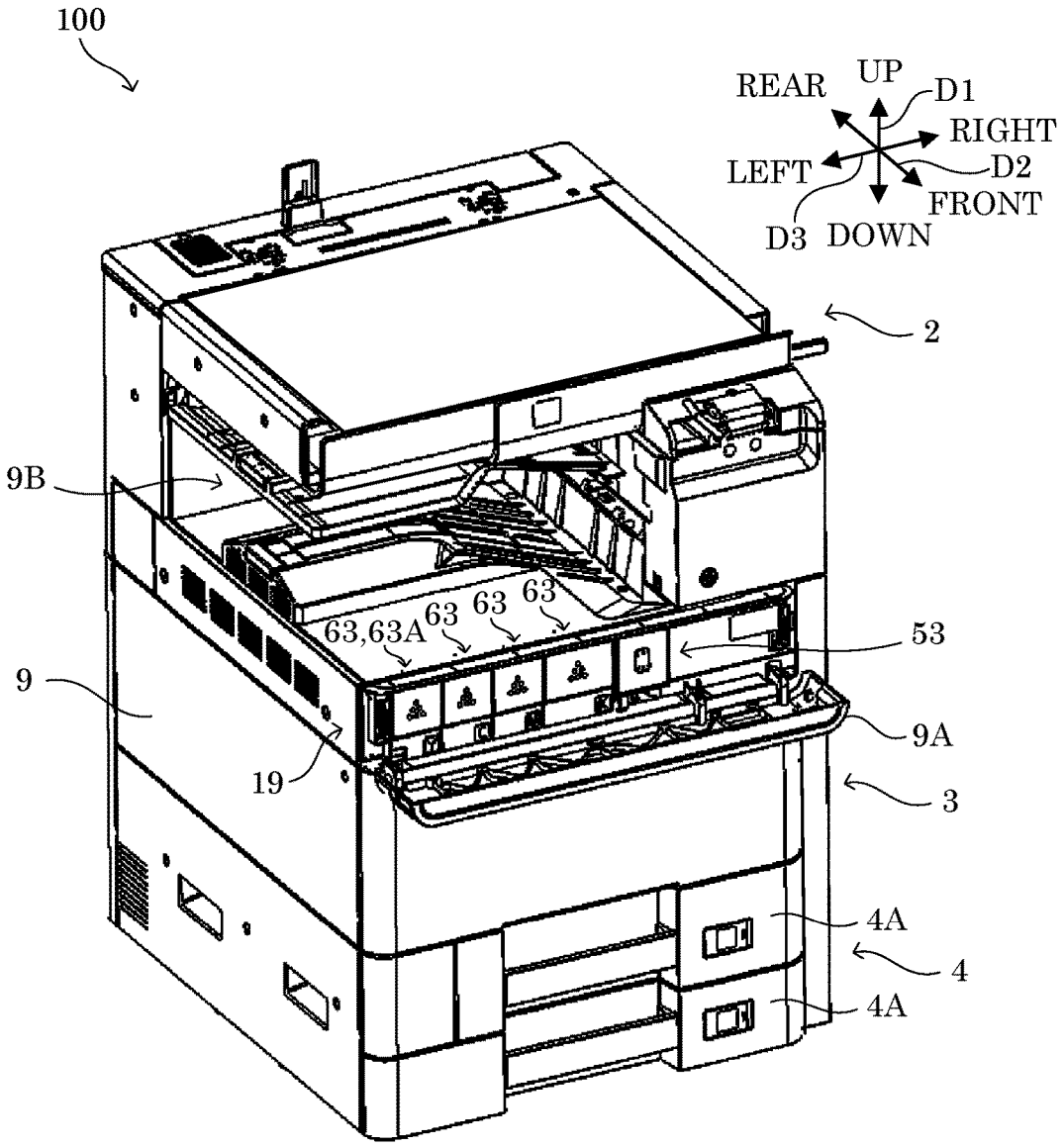
FIG. 2 is a diagram showing an appearance of the image forming apparatus according to the embodiment of the present disclosure.

As shown in FIG. 1 and FIG. 2, the image forming apparatus 100 includes the ADF (Auto Document Feeder) 1, an image reading portion 2, an image forming portion 3, a sheet feed portion 4, an operation/display portion 5, a storage portion 6, a first control portion 7, a second control portion 8, and a housing 9.

The ADF 1 conveys the document sheet targeted to be read by the scan function. For example, the ADF 1 includes a document setting portion, a plurality of conveying rollers, a document sheet holder, and a sheet ejecting portion.

The image reading portion 2 realizes the scan function. For example, the image reading portion 2 includes a document sheet table, a light source, a plurality of mirrors, an optical lens, and a CCD (Charge Coupled Device).

The image forming portion 3 realizes the print function. Specifically, the image forming portion 3 forms the image by electrophotography. For example, the image forming portion 3 forms the image by using developer including toner (an example of the developer of the present disclosure) and career.

The sheet feed portion 4 feeds a sheet to the image forming portion 3. For example, the sheet feed portion 4 includes sheet feed cassettes 4A (see FIG. 2), a sheet conveyance path, and a plurality of conveying rollers.

The operation/display portion 5 is a user interface of the image forming apparatus 100. For example, the operation/display portion 5 includes a display portion such as a liquid crystal display that displays various types of information in accordance with control commands from the first control portion 7, and an operation portion such as an operation key or a touch panel, which inputs various types of information to the first control portion 7 in accordance with operations of a user.

The storage portion 6 is a non-volatile storage device. For example, the storage portion 6 is a storage device such as: a non-volatile memory such as a flash memory or an EEPROM; an SSD (Solid State Drive); or an HDD (Hard Disk Drive).

A piece of user information regarding a user who can log in the image forming apparatus 100, is stored in the storage portion 6. The piece of user information includes a piece of authentication information used to authenticate the user. For example, the piece of authentication information is a user name and a password. The piece of user information includes a piece of print history information indicating a print history of the user. The print history of the user is recorded by the first control portion 7.

The first control portion 7 centrally controls the image forming apparatus 100. As shown in FIG. 1, the first control portion 7 includes a CPU 7A, a ROM 7B, and a RAM 7C. The CPU 7A is a processor that executes various types of calculation process. The ROM 7B is the non-volatile storage device in which information such as control program for causing the CPU 7A to execute various types of process is prestored. The RAM 7C is a volatile storage device used as a temporary storage memory (working area) for the various types of process executed by the CPU 7A. In the first control portion 7, the CPU 7A executes the various types of control program that is prestored in the ROM 7B. Thus, the image forming apparatus 100 is centrally controlled by the first control portion 7.

The second control portion 8 controls the image forming portion 3. For example, the second control portion 8 is composed of electronic circuits such as integrated circuits (ASIC, DSP).

The housing 9 houses some components of the image forming apparatus 100. As shown in FIG. 2, the housing 9 is formed in a substantially square columnar shape. The sheet feed cassettes 4A are provided at a lower portion of the housing 9 so as to be inserted and extracted in the front-rear direction D2. A front cover 9A is provided on the front surface of the housing 9. A lower end part of the front cover 9A is supported in such a way as to be pivotable around a rotary shaft that is elongated in the left-right direction D3, and the front cover 9A is opened as its upper part pivots forward. On the housing 9, there is provided a sheet ejecting space 9B that is opened to the left and the front. A sheet with an image formed thereon by the image forming portion 3 is ejected into the sheet ejecting space 9B.

[Configuration of Image Forming Portion 3]

Figure 3:
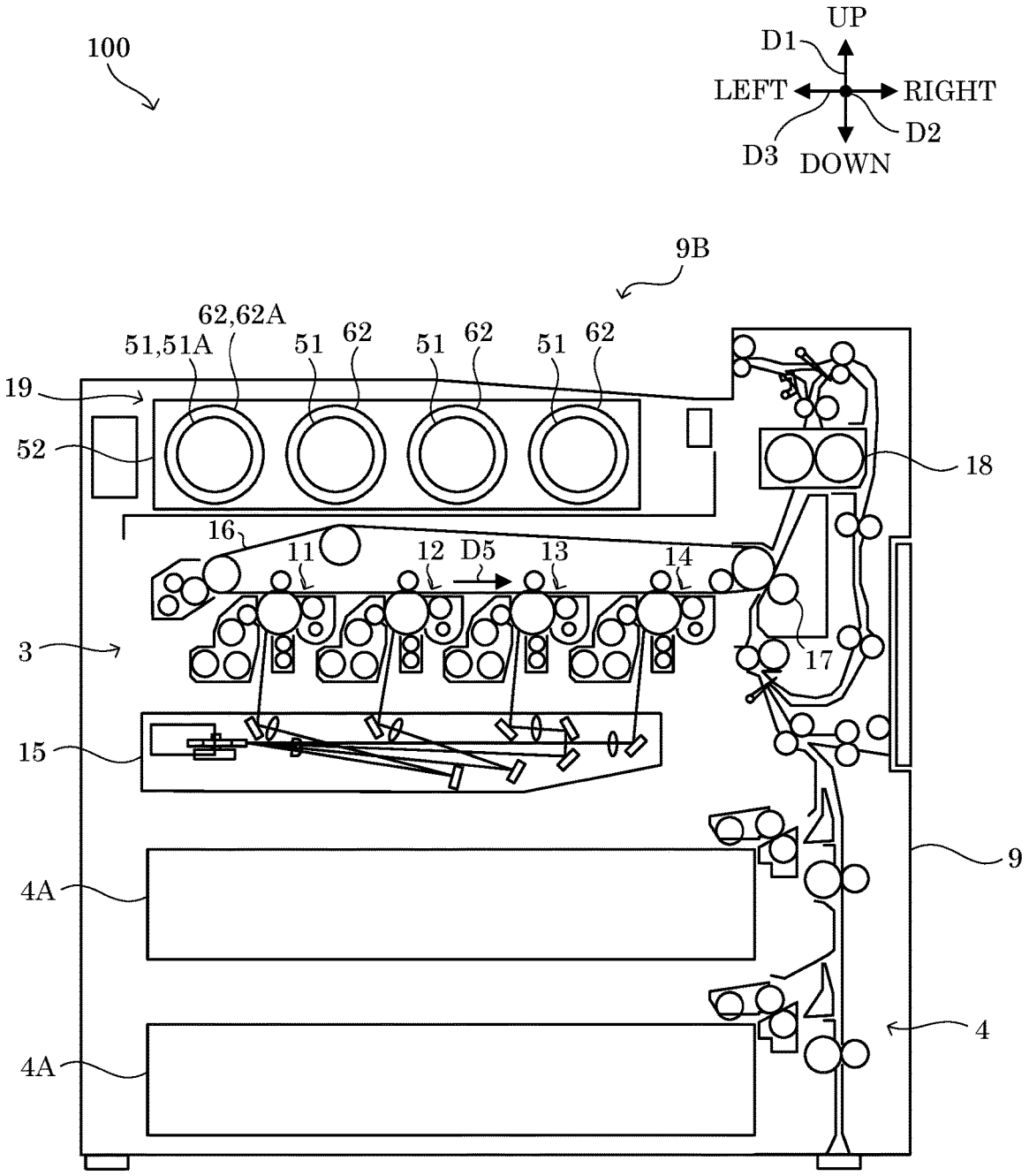
FIG. 3 is a diagram showing an internal configuration of the image forming apparatus according to the embodiment of the present disclosure.

Next, a configuration of the image forming portion 3 will be described with reference to FIG. 3 and FIG. 4. Here, FIG. 3 is a cross-sectional view showing an internal configuration of the housing 9. In addition, FIG. 4 is a cross-sectional view showing a configuration of an image forming unit 11.

As shown in FIG. 3, the image forming portion 3 includes a plurality of image forming units 11 to 14, a laser scanning unit 15, an intermediate transfer belt 16, a secondary transfer roller 17, a fixing device 18, and a toner supply device 19, and temperature sensor 20 (see FIG. 1).

The image forming units 11 to 14 are electrophotographic image forming units, the image forming unit 11 corresponding to Y (yellow), the image forming unit 12 corresponding to C (cyan), the image forming unit 13 corresponding to M (magenta), and the image forming unit 14 corresponding to K (black). As shown in FIG. 3, the image forming units 11 to 14 are aligned along the left-right direction D3 of the image forming apparatus 100, in the order of yellow, cyan, magenta, and black from the left side of the image forming apparatus 100.

Figure 4:
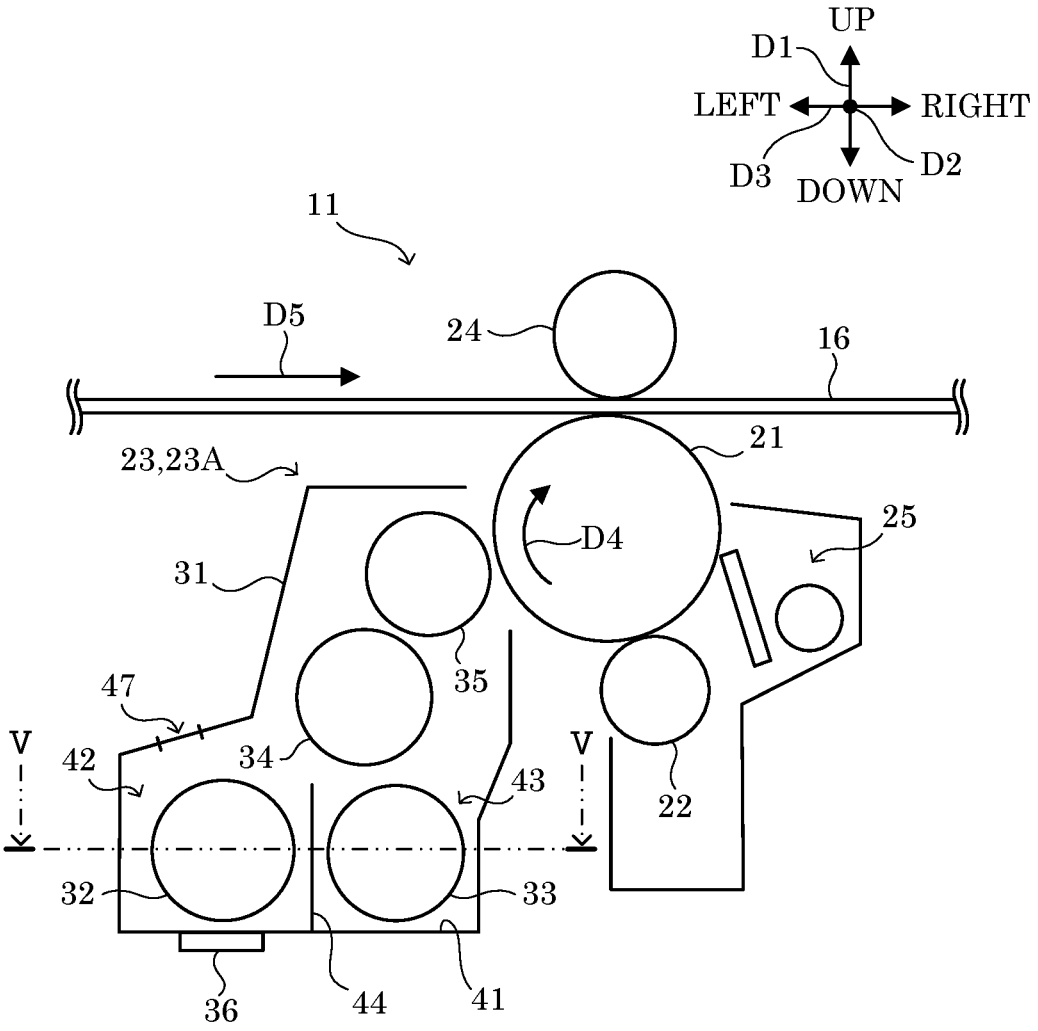
FIG. 4 is a diagram showing a configuration of an image forming unit in the image forming apparatus according to the embodiment of the present disclosure.

As shown in FIG. 4, the image forming unit 11 includes a photoconductor drum 21, a charging roller 22, a development portion 23, a primary transfer roller 24, and a drum cleaning portion 25. In addition, the image forming units 12 to 14 have the same configuration as the image forming unit 11.

An electrostatic latent image is formed on a surface of the photoconductor drum 21. The photoconductor drum 21 receives a rotational driving force that is supplied from a motor (not shown) and rotates in a rotational direction D4 shown in FIG. 4.

The charging roller 22 charges the surface of the photoconductor drum 21. A light emitted from the laser scanning unit 15 based on the image data is irradiated to the surface of the photoconductor drum 21 that has been charged by the charging roller 22. This allows the electrostatic latent image to be formed on the surface of the photoconductor drum 21.

The development portion 23 develops the electrostatic latent image formed on the surface of the photoconductor drum 21 by using the developer. This allows a toner image to be formed on the surface of the photoconductor drum 21.

The primary transfer roller 24 transfers the toner image that has been formed on the surface of the photoconductor drum 21 by the development portion 23, to the intermediate transfer belt 16.

The drum cleaning portion 25 removes the toner remaining on the surface of the photoreceptor drum 21 after the transfer of the toner image by the primary transfer roller 24.

The laser scanning unit 15 emits light based on the image data, toward the surfaces of the photoconductor drums 21 of the image forming units 11 to 14.

The intermediate transfer belt 16 is an endless belt member to which the toner images formed on the surfaces of the photoconductor drums 21 of the image forming units 11 to 14 are transferred. The intermediate transfer belt 16 is stretched by a drive roller and a stretch roller with a predetermined tension. The drive roller is rotated in response to a rotational driving force that is supplied from a motor (not shown), and thereby the intermediate transfer belt 16 is rotated in a rotational direction D5 shown in FIG. 3.

The secondary transfer roller 17 transfers the toner image that has been transferred on the surface of the intermediate transfer belt 16, to the sheet that is fed from the sheet feed portion 4.

The fixing device 18 fixes the toner image that has been transferred to the sheet by the secondary transfer roller 17, to the sheet.

The toner supply device 19 supplies the toner to the development portions 23 of the image forming units 11 to 14.

The temperature sensor 20 detects the temperature inside the housing 9.

[Configuration of Development Portion 23]

Next, a configuration of the development portion 23 will be described with reference to FIG. 4 and FIG. 5. Here, FIG. 5 is a cross-sectional view taken along a V-V line and viewed from the direction of arrows of FIG. 4.

Figure 5:
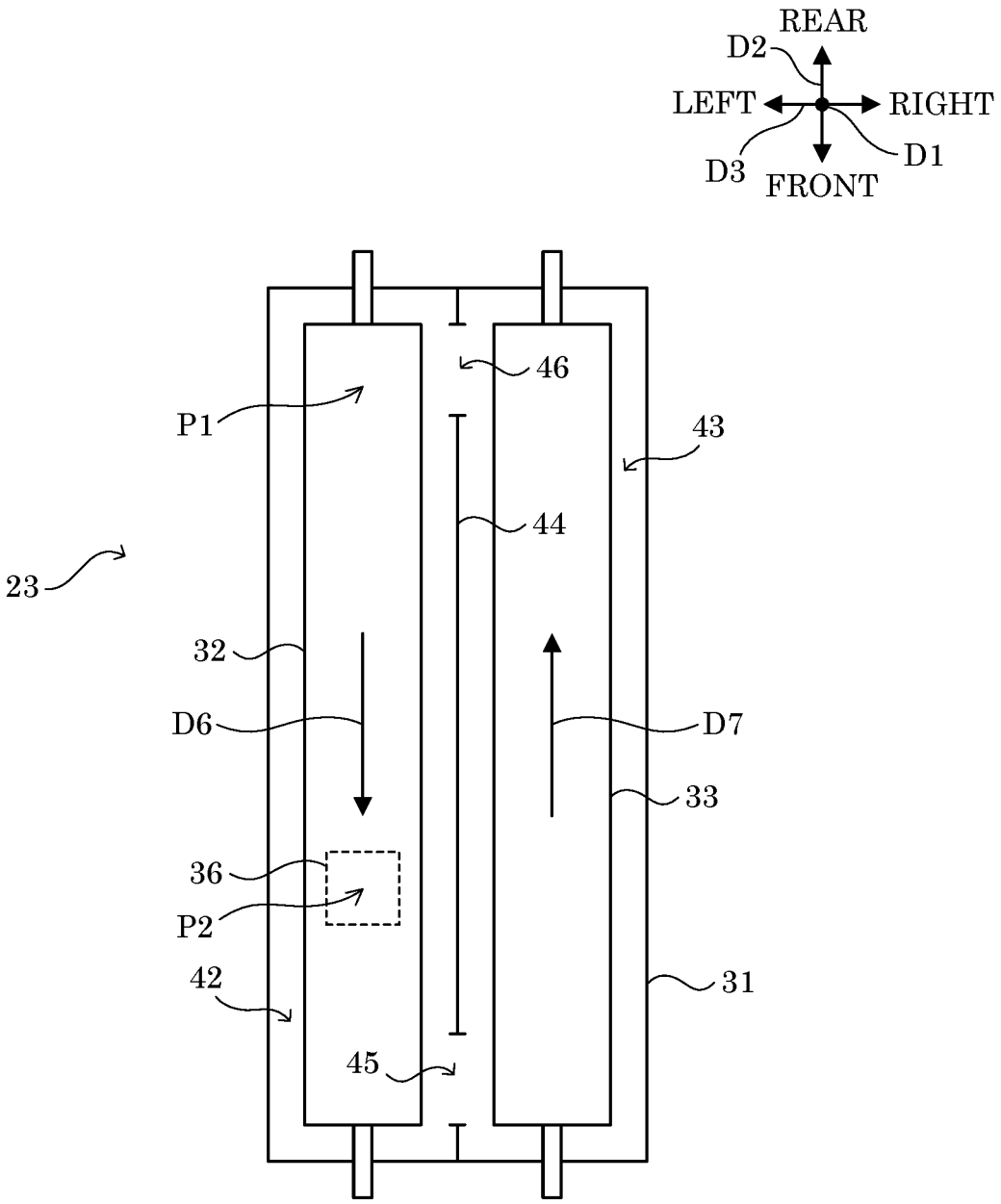
FIG. 5 is a diagram showing a configuration of a development portion in the image forming apparatus according to the embodiment of the present disclosure.

As shown in FIG. 4 and FIG. 5, the development portion 23 includes a housing 31, a first conveyance member 32, a second conveyance member 33, a magnet roller 34, a developing roller 35, and a toner sensor 36.

As shown in FIG. 4, the housing 31 houses the first conveyance member 32, the second conveyance member 33, the magnet roller 34, and the developing roller 35. In addition, the housing 31 stores the developer. Specifically, the housing 31 stores the developer in an internal space defined by side walls and a bottom 41. The development portion 23 develops the electrostatic latent image that has been formed on the surface of the photoconductor drum 21 by using the developer stored in the housing 31. The housing 31 is an example of a storing portion of the present invention.

As shown in FIG. 5, the housing 31 has a first conveyance path 42 and a second conveyance path 43 in which the developer including the toner is conveyed. Specifically, as shown in FIG. 4 and FIG. 5, a partition wall 44 is provided on the bottom 41 of the housing 31. The side walls, the bottom 41, and the partition wall 44 of the housing 31 form the first conveyance path 42 and the second conveyance path 43 in which the developer is conveyed in the housing 31.

As shown in FIG. 5, the first conveyance member 32 is provided in the first conveyance path 42. The first conveyance member 32 conveys the developer along a conveyance direction D6 along the front-rear direction D2 in the first conveyance path 42, and charges the toner included in the developer. Specifically, the first conveyance member 32 stirs the developer during the conveyance of the developer, and charges the toner included in the developer. For example, the first conveyance member 32 is a screw-shaped member.

As shown in FIG. 5, the second conveyance member 33 is provided in the second conveyance path 43. The second conveyance member 33 conveys the developer along a conveyance direction D7 along the front-rear direction D2 in the second conveyance path 43, and charges the toner included in the developer. Specifically, the second conveyance member 33 stirs the developer during the conveyance of the developer, and charges the toner included in the developer. For example, the second conveyance member 33 is a screw-shaped member.

A first connection portion 45 that connects the first conveyance path 42 and the second conveyance path 43 is provided at a downstream end, in the conveyance direction D6, of the partition wall 44. On the other hand, a second connection portion 46 that connects the first conveyance path 42 and the second conveyance path 43 is provided at a downstream end, in the conveyance direction D7, of the partition wall 44. Thus, the developer that is stored in the housing 31 is circulated and conveyed through the first conveyance path 42 and the second conveyance path 43 by the first conveyance member 32 and the second conveyance member 33.

The magnet roller 34 draws up the developer that is conveyed by the second conveyance member 33, from the second conveyance path 43. The magnet roller 34 supplies the toner included in the developer drawn up from the second conveyance path 43, to the developing roller 35. The developing roller 35 develops the electrostatic latent image that is formed on the surface of the photoconductor drum 21 by using the toner supplied from the magnet roller 34.

It is noted that the development method adopted by the development portion 23 is not limited to the two-component development method using the developer that includes the toner and the career. The development method of the development portion 23 may be, e.g., one-component development method using only the toner. In addition, the development portion 23 may be configured without the magnet roller 34.

An opening portion 47 is provided above the first conveyance path 42. As shown in FIG. 4, the opening portion 47 is provided in an upper surface of the housing 31 that covers the first conveyance path 42 from above. The opening portion 47 is provided facing an upstream end, in the conveyance direction D6, of the first conveyance path 42. The opening portion 47 is used to convey the toner that is supplied from a toner container 51, which is described later, into the first conveyance path 42. Specifically, the toner that is supplied from the toner container 51 passes through the opening portion 47 and is conveyed to a conveyance position P1 (see FIG. 5) of the first conveyance path 42. The conveyance position P1 is a position provided on the bottom 41 to face the opening portion 47.

The toner sensor 36 detects an amount of toner at a detection position P2 (see FIG. 5) positioned on a more downstream side in the conveyance direction D6 than the conveyance position P1 in the first conveyance path 42. The toner sensor 36 is, for example, provided on a bottom of the housing 31, as shown in FIG. 4. The toner sensor 36 is, for example, a permeability sensor including an LC oscillation circuit that outputs an electric signal corresponding to a permeability of the developer stored inside the housing 31.

For example, in the image forming apparatus 100, the amount of toner stored inside the housing 31 is obtained by integrating the values detected by the toner sensor 36 during a detection period that is longer than the time required for the first conveyance member 32 to convey the toner from the conveyance position P1 to the detection position P2. For example, the detection period equals to a time period required for the toner that is conveyed by the first conveyance member 32 to circulate inside the development portion 23 once.

[Configuration of Toner Supply Device 19]

Figure 6:
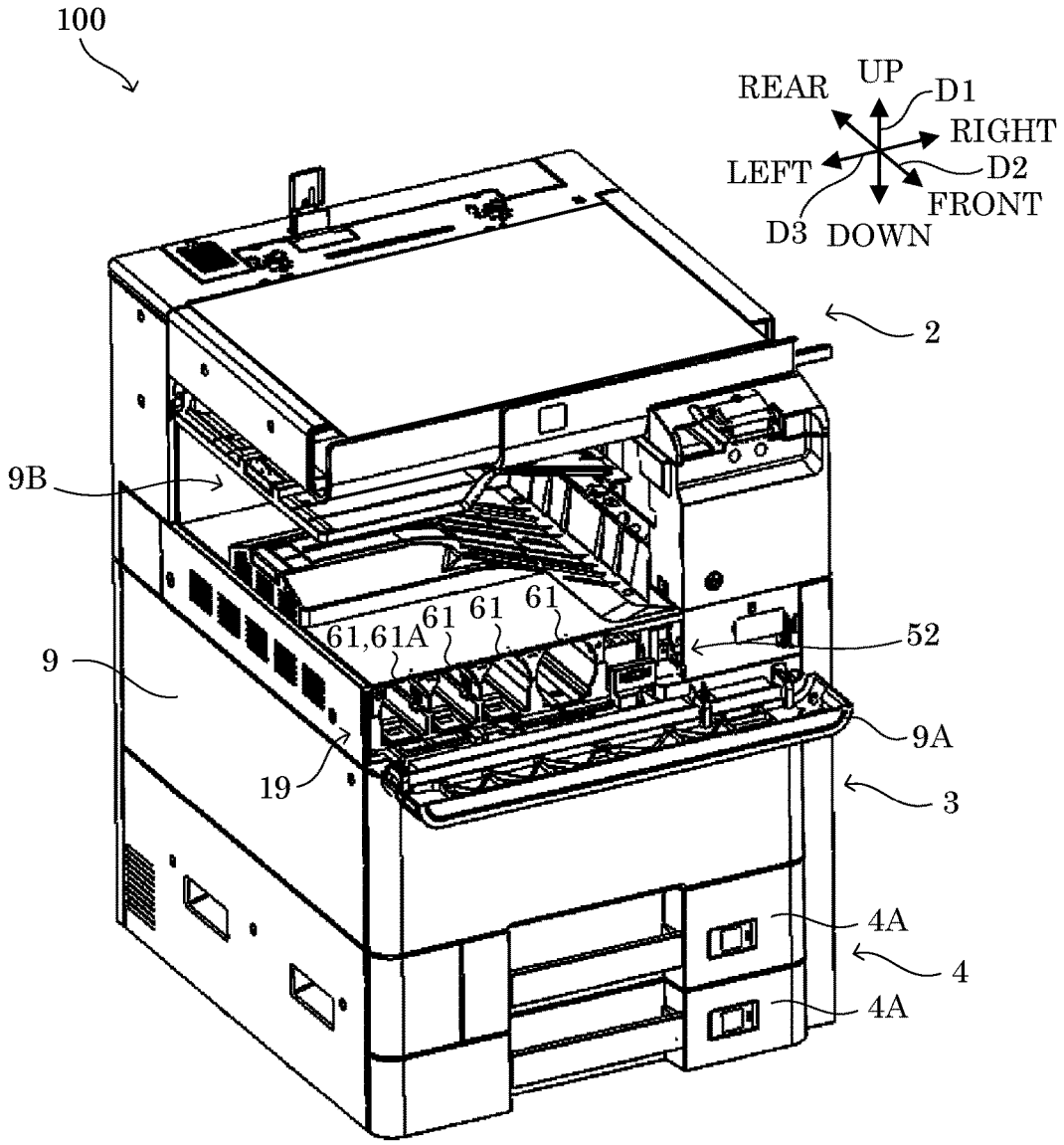
FIG. 6 is a diagram showing an appearance of the image forming apparatus according to the embodiment of the present disclosure.
Figure 7:
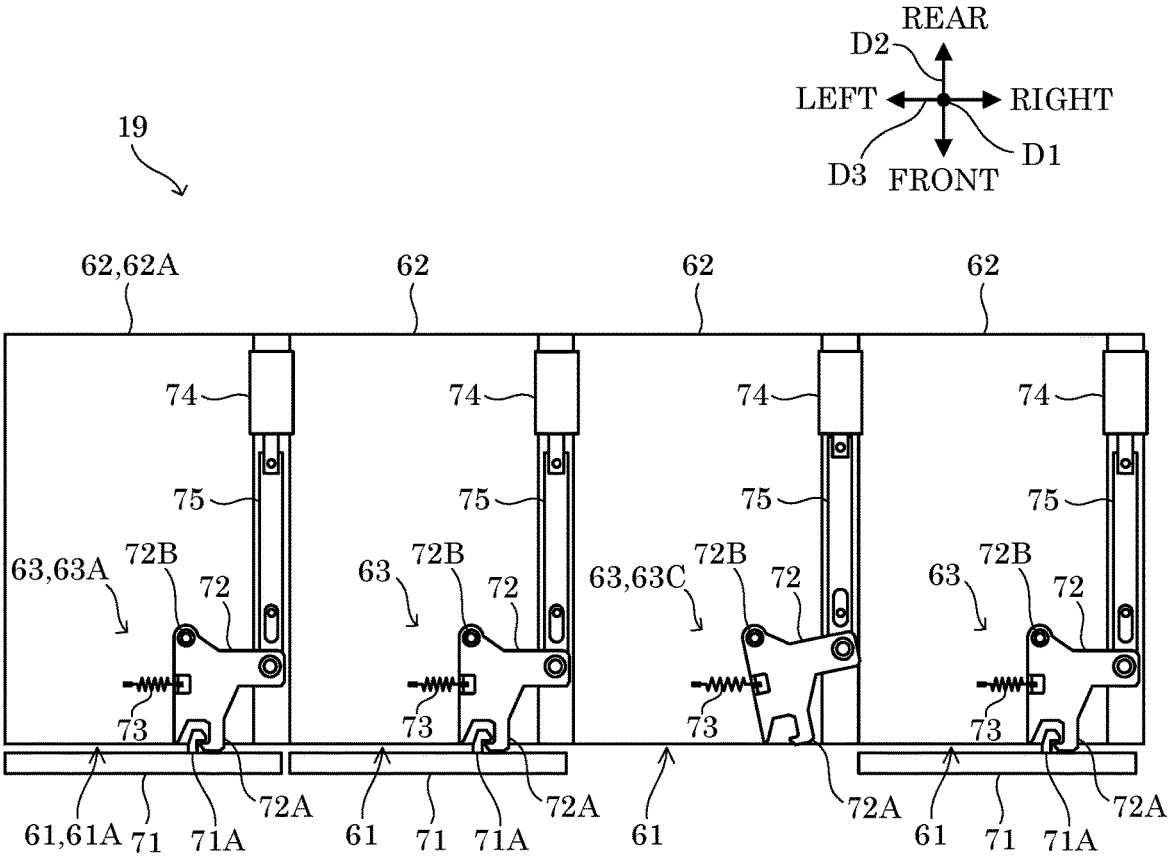
FIG. 7 is a diagram showing a configuration of a toner supply device in the image forming apparatus according to the embodiment of the present disclosure.

Next, a configuration of the toner supply device 19 will be described with reference to FIG. 1 to FIG. 3, FIG. 6 and FIG. 7. Here, FIG. 6 is a drawing showing a state in which a lock unit 53 is removed from the image forming apparatus 100 shown in FIG. 2. In addition, FIG. 7 is a plan view showing a configuration of the toner supply device 19.

The toner supply device 19 includes four toner containers 51 shown in FIG. 3, a container attachment portion 52 shown in FIG. 6, and the lock unit 53 shown in FIG. 2. In addition, as shown in FIG. 1, the toner supply device 19 includes a drive portion 54, a data acquisition portion 55, and an open/close sensor 56.

The four toner containers 51 are provided in correspondence with the image forming units 11 to 14. For example, a toner container 51A shown in FIG. 3 corresponds to the image forming unit 11 and stores yellow toner.

The four toner containers 51 have the same configuration as each other. Specifically, each toner container 51 is a substantially cylindrical container that is elongated along the front-rear direction D2. Each toner container 51 includes a conveyance member (not shown) that conveys the toner stored therein along a longitudinal direction of each toner container 51, and an IC tag (not shown) that stores specific data regarding each toner container 51. For example, the specific data includes identification information of each toner container 51, toner information regarding the type, material, and color of the toner stored in each toner container 51, and initial storage capacity information showing an initial storage capacity of the toner in each toner container 51. The toner container 51 is an example of a developer storing portion of the present disclosure.

The four toner containers 51 are attached to the container attachment portion 52. As shown in FIG. 3, the container attachment portion 52 is provided at an upper part of the housing 9. In addition, as shown in FIG. 6, the container attachment portion 52 is provided in the housing 9 at a position facing a rear of the front cover 9A. Four opening portions 61 (see FIG. 6) and four attachment portions 62 (see FIG. 3) are formed in the container attachment portion 52.

The four opening portions 61 are provided in correspondence with the four toner containers 51. The toner containers 51 are inserted into the corresponding opening portions 61. For example, the toner container 51A is inserted into an opening portion 61A shown in FIG. 6.

The four attachment portions 62 are provided in correspondence with the four opening portions 61. Each attachment portion 62 forms a storage space for storing a toner container 51, extending from the corresponding opening portion 61 toward the rear of the image forming apparatus 100. The toner containers 51 are attached to the attachment portions 62. For example, the toner container 51A is attached to an attachment portion 62A shown in FIG. 3.

The lock unit 53 is configured to regulate the removal of the toner containers 51 attached to the container attachment portion 52 from the container attachment portion 52. As shown in FIG. 2, the lock unit 53 is mounted to the front of the container attachment portion 52. The lock unit 53 includes four lock devices 63 configured to individually switch between placing and not placing restrictions on opening and closing of (between locking and not locking) the four opening portions 61.

The four lock devices 63 have the same configuration as each other. Specifically, as shown in FIG. 7, each lock device 63 includes a lock cover 71, a restriction member 72, a coil spring 73, a solenoid 74, and a link member 75. The restriction member 72, the coil spring 73, the solenoid 74, and the link member 75 in each lock device 63 are provided on an upper surface of the corresponding attachment portion 62. Each lock device 63 regulates the removal of a toner container 51 attached to the corresponding attachment portion 62 from the attachment portion 62. The lock device 63 is an example of a regulation portion of the present disclosure.

The lock cover 71 is provided at each opening portion 61 in such a way as to open and close the opening portion 61. The lock cover 71 is supported such that its lower end portion is pivotable around a rotary shaft that is elongated in the left-right direction D3. That is, the lock cover 71 is opened as its upper part pivots forward, in the same manner as the front cover 9A.

An engaged portion 71A that can be engaged with an engaging portion 72A of the restriction member 72, is provided at the upper part of the lock cover 71. As shown in FIG. 7, the engaged portion 71A has a hook shape that protrudes from the rear of the lock cover 71 and bends to the right.

The restriction member 72 includes the engaging portion 72A that is engaged with the engaged portion 71A of the lock cover 71. As shown in FIG. 7, the engaging portion 72A has a hook shape that protrudes forward and bends to the left. The restriction member 72 is pivotably provided on the upper surface of each attachment portion 62. Specifically, the restriction member 72 is pivotably supported by a rotary shaft 72B that is provided parallel to the up-down direction D1, on the upper surface of each attachment portion 62.

The restriction member 72 can be rotated between a lock position where opening of the lock cover 71 can be restricted and a releasing position where opening restriction (locking) of the lock cover 71 is released. Here, as shown in FIG. 7, the lock position is a position where the engaging portion 72A is engaged with the engaged portion 71A of the closed lock cover 71. In addition, the releasing position is more inside the lock cover 71 than the lock position, and is a position where the engagement between the engaging portion 72A and the engaged portion 71A of the lock cover 71 is released (see a lock device 63C in FIG. 7). In the lock device 63, opening of the lock cover 71 is restricted by the restriction member 72, and thereby attachment/detachment of a toner container 51 to/from the corresponding attachment portion 62 is regulated.

The coil spring 73 biases the restriction member 72 toward the lock position side. Specifically, as shown in FIG. 7, the coil spring 73 extends in the left-right direction D3 on the upper surface of each attachment portion 62. One end of the coil spring 73 in the longitudinal direction is fixed to the left side of the restriction member 72, and the other end is fixed to the upper surface of each attachment portion 62. The coil spring 73 is fixed to the restriction member 72 and the upper surface of each attachment portion 62 in a state of being stretched to be longer than its natural length. Therefore, the restriction member 72 is pulled to the left direction by the coil spring 73 and biased to the lock position side.

As shown in FIG. 7, the solenoid 74 is provided more inside the lock cover 71 than the restriction member 72. The solenoid 74 is driven in response to energization to cause the restriction member 72 to be moved to the releasing position. Specifically, the solenoid 74 has what is called a pull-type driven configuration, and has a plunger that is elongated along the front-rear direction D2. The plunger is connected to the restriction member 72 via the link member 75 that is elongated in the front-rear direction D2.

The solenoid 74 drives the plunger rearward in response to power supply from a power source (not shown) based on control commands of the first control portion 7. Thus, the restriction member 72 that is connected to the plunger via the link member 75 is moved from the lock position to the releasing position, and then locking of the lock cover 71 is released (see the lock device 63C in FIG. 7).

The drive portion 54 is provided in each attachment portion 62. The drive portion 54 generates a rotational driving force that is supplied to the conveyance member of a toner container 51 attached to an attachment portion 62 corresponding to the drive portion 54. For example, the drive portion 54 is a motor. The rotational driving force generated in the drive portion 54 is supplied to the conveyance member of the toner container 51 attached to the corresponding attachment portion 62 via a power transmission mechanism (not shown). Thus, the conveyance member is rotated so that the toner stored in the toner container 51 is conveyed to a toner outlet (not shown) provided inside the toner container 51. The toner outlet of the toner container 51 attached to the corresponding attachment portion 62 is connected to a toner supply path (not shown) leading to the opening portion 47 (see FIG. 4) of the development portion 23. The toner that is discharged from the toner outlet to the outside of the toner container 51 is supplied to the development portion 23 via the toner supply path and the opening portion 47.

The data acquisition portion 55 is provided in each attachment portion 62. The data acquisition portion 55 acquires the specific data from the IC tag of a toner container 51 attached to an attachment portion 62 corresponding to the data acquisition portion 55. For example, the data acquisition portion 55 receives the specific data from the IC tag by executing short-range wireless communication with the IC tag of the toner container 51 attached to the corresponding attachment portion 62.

The open/close sensor 56 detects whether the front cover 9A of the housing 9 is in an opened state or a closed state. For example, the open/close sensor 56 is a reflective optical sensor.

[Configuration of First Control Portion 7]

Next, a configuration of the first control portion 7 will be described with reference to FIG. 1.

As shown in FIG. 1, the first control portion 7 includes an authentication processing portion 91, a supply processing portion 92, a first release processing portion 93, an acquisition processing portion 94, a setting processing portion 95, a second release processing portion 96, a notification processing portion 97, and a third release processing portion 98.

Specifically, a regulation releasing program for causing the CPU 7A of the first control portion 7 to execute a regulation releasing process (see a flowchart in FIG. 8) and a printing control process (see a flowchart in FIG. 9), which will be described later, are prestored in the ROM 7B of the first control portion 7. The CPU 7A of the first control portion 7 functions as the above-described components by executing the restriction releasing program stored in the ROM 7B.

The regulation releasing program is recorded in a computer-readable recording medium such as CD, DVD, or flash memory, and may be read from the recording medium and stored in a storage device such as the storage portion 6.

The following describes an example case where, among the development portions 23, the toner containers 51, the attachment portions 62, and the lock devices 63 corresponding to the image forming units 11 to 14, a development portion 23A (see FIG. 4), the toner container 51A (see FIG. 3), the attachment portion 62A (see FIG. 3), and the lock device 63A (see FIG. 2) corresponding to the image forming unit 11 are focused. The following description also applies to the development portions 23, the toner containers 51, the attachment portions 62, and the lock devices 63 corresponding to the image forming units 12 to 14.

The authentication processing portion 91 authenticates the user of the image forming apparatus 100. For example, the authentication processing portion 91 authenticates the user of the image forming apparatus 100 by using the piece of authentication information stored in the storage portion 6.

For example, the authentication processing portion 91 causes an authentication screen used for a predetermined authentication operation to be displayed on the operation/display portion 5 in accordance with a predetermined call operation performed on the operation/display portion 5. The authentication processing portion 91 accepts the authentication operation on the authentication screen. For example, the authentication operation is an operation to enter the user name and the password. After that, in a case where the information entered from the operation/display portion 5 matches any piece of authentication information stored in the storage portion 6, the authentication processing portion 91 authenticates the user. That is, the authentication processing portion 91 allows the user to log in the image forming apparatus 100.

When a predetermined logout operation is performed on the operation/display portion 5, in a case in which a predetermined time has elapsed or another user logs in, the authentication processing portion 91 executes a logout process that causes a currently logged-in user to be logged out.

When a storage amount of toner in the housing 31 of the development portion 23A is less than or equal to a predetermined first threshold, the supply processing portion 92 supplies the toner from the toner container 51A attached to the attachment portion 62A to the housing 31 of the development portion 23A. Thus, the storage amount of toner in the housing 31 of the development portion 23A is maintained within a predetermined range that includes the first threshold, until a remaining amount of toner inside the toner container 51A becomes empty.

Specifically, the supply processing portion 92 acquires the storage amount of toner in the housing 31 of the development portion 23A by using the toner sensor 36 of the development portion 23A. In addition, the supply processing portion 92 supplies the toner from the toner container 51A attached to the attachment portion 62A to the housing 31 of the development portion 23A, by driving the drive portion 54 corresponding to the attachment portion 62A and rotating the conveyance member inside the toner container 51A by a predetermined reference amount.

For example, during execution of a printing process of forming an image on a sheet using the image forming portion 3, the supply processing portion 92 determines whether or not the storage amount of toner in the housing 31 of the development portion 23A is less than or equal to the first threshold, in a predetermined determination cycle.

When the storage amount of toner in the housing 31 of the development portion 23A is less than or equal to a second threshold, which is lower than the first threshold, the first release processing portion 93 restricts operation of the image forming portion 3 and releases regulation on the removal of the toner container 51A imposed by the lock device 63A. Thus, as compared with a configuration in which replacement of the toner container 51A is not regulated, it is possible to reduce the remaining amount of toner inside the toner container 51A at a time of replacement of the toner container 51A.

Specifically, when the storage amount of toner in the housing 31 of the development portion 23A acquired by using the toner sensor 36 of the development portion 23A is less than or equal to the second threshold, the first release processing portion 93 stops the printing process under execution, and also prohibits execution of a new printing process.

When the storage amount of toner in the housing 31 of the development portion 23A acquired by using the toner sensor 36 of the development portion 23A is less than or equal to the second threshold, the first release processing portion 93 waits for a predetermined specific operation to be performed by the user. For example, the specific operation is an operation to open the front cover 9A. For example, the first release processing portion 93 detects the opening of the front cover 9A by using the open/close sensor 56. The specific operation may be a predetermined operation performed on the operation/display portion 5.

When the specific operation performed by the user is detected, the first release processing portion 93 releases regulation on the removal of the toner container 51A imposed by the lock device 63A. Specifically, the first release processing portion 93 drives the solenoid 74 of the lock device 63A so that the restriction member 72 of the lock device 63A is moved from the lock position to the releasing position, thereby releasing regulation on the removal of the toner container 51A imposed by the lock device 63A.

When the storage amount of toner in the housing 31 of the development portion 23A acquired by using the toner sensor 36 of the development portion 23A is less than or equal to the second threshold, the first release processing portion 93 may release regulation on the removal of the toner container 51A imposed by the lock device 63A, regardless of whether or not the specific operation has been performed.

Meanwhile, if the toner container 51A attached to the attachment portion 62A cannot be replaced until the storage amount of toner in the housing 31 of the development portion 23A is less than or equal to the second threshold and the operation of the image forming portion 3 is restricted, it is impossible to avoid stop of printing due to decrease in the remaining amount of toner.

In contrast, in the image forming apparatus 100 according to the embodiment of the present disclosure, as described below, it is possible to reduce the remaining amount of toner inside the toner container 51 at a time of replacement, and avoid stop of printing due to decrease in the remaining amount of toner.

The acquisition processing portion 94 acquires an expected amount of toner to be used by a user.

For example, the acquisition processing portion 94 acquires the expected amount of toner to be used by the user, based on a print history of the user authenticated by the authentication processing portion 91.

For example, the acquisition processing portion 94 acquires an average value of the amount of toner used for each execution timing of the printing process in a predetermined specific period (an average value of the amount of toner used per one printing process), as the expected amount of toner to be used by the authenticated user. For example, the specific period is a period of one week or one month up to the present. The acquisition processing portion 94 may acquire the maximum value of the amount of toner used for each execution timing of the printing process in the specific period, as the expected amount of toner to be used by the authenticated user.

The acquisition processing portion 94 may acquire the expected amount of toner to be used by the user, based on an operation performed by the user on the operation/display portion 5. For example, the acquisition processing portion 94 may cause an entry screen used for entering the expected amount of toner to be used to be displayed on the operation/display portion 5, and then may acquire information entered on the entry screen, as the expected amount of toner to be used. In addition, the acquisition processing portion 94 may acquire the amount of toner consumed in the printing process that was executed immediately before, as the expected amount of toner to be used.

The setting processing portion 95 sets a predetermined reference value based on the remaining amount of toner in the toner container 51A attached to the attachment portion 62A and the temperature inside the image forming apparatus 100.

For example, in the image forming apparatus 100, each time the printing process is executed, the amount of toner consumed in the printing process is recorded. For example, the first control portion 7 acquires the amount of toner consumed in the printing process, based on a printing rate of the image data printed in the printing process. The first control portion 7 then stores the acquired consumption amount of toner together with a piece of information such as the execution timing of the printing process, on a predetermined storage area in the storage portion 6.

The setting processing portion 95 acquires the remaining amount of toner in the toner container 51A, based on a total consumption amount of toner from a start timing of use of the toner container 51A that is attached to the attachment portion 62A and the initial storage capacity information included in the specific data that is acquired from the IC tag of the toner container 51A by the data acquisition portion 55 corresponding to the attachment portion 62A.

For example, when the temperature detected by the temperature sensor 20 exceeds a predetermined reference temperature, the setting processing portion 95 sets the remaining amount of toner in the toner container 51A as the reference value. In addition, when the temperature detected by the temperature sensor 20 is less than or equal to the reference temperature, the setting processing portion 95 sets a multiplication result of the remaining amount of toner in the toner container 51A and a predetermined coefficient, as the reference value. For example, the reference temperature is 10 degrees. The coefficient is 0.8. The reference temperature and the coefficient may be set arbitrarily.

The setting processing portion 95 may set the remaining amount of toner in the toner container 51A as the reference value, regardless of whether or not the temperature detected by the temperature sensor 20 exceeds the reference temperature.

When the expected amount of toner to be used acquired by the acquisition processing portion 94 is greater than or equal to the reference value that is set by the setting processing portion 95, the second release processing portion 96 releases regulation on the removal of the toner container 51A imposed by the lock device 63A.

For example, when the expected amount of toner to be used acquired by the acquisition processing portion 94 is greater than or equal to the reference value that is set by the setting processing portion 95, the second release processing portion 96 waits for the specific operation to be performed by the user. When the specific operation performed by the user is detected, the second release processing portion 96 releases regulation on the removal of the toner container 51A imposed by the lock device 63A.

When the expected amount of toner to be used acquired by the acquisition processing portion 94 is greater than or equal to the reference value that is set by the setting processing portion 95, the second release processing portion 96 may release regulation on the removal of the toner container 51A imposed by the lock device 63A, regardless of whether or not the specific operation has been performed.

The notification processing portion 97 notifies the user that the toner container 51A can be replaced when the expected amount of toner to be used acquired by the acquisition processing portion 94 is greater than or equal to the reference value.

For example, the notification processing portion 97 causes a notification screen including a message indicating that the toner container 51A can be replaced, to be displayed on the operation/display portion 5.

When the storage amount of toner in the housing 31 of the development portion 23A is less than or equal to a third threshold, which is lower than the first threshold and higher than the second threshold, the third release processing portion 98 releases regulation on the removal of the toner container 51A imposed by the lock device 63A.

For example, when the latest storage amount of toner in the housing 31 of the development portion 23A, which is acquired in the printing process executed immediately before, is less than or equal to the third threshold, the third release processing portion 98 waits for the specific operation to be performed by the user. When the specific operation performed by the user is detected, the third release processing portion 98 releases regulation on the removal of the toner container 51A imposed by the lock device 63A.

When the latest storage amount of toner in the housing 31 of the development portion 23A, which is acquired in the printing process executed immediately before, is less than or equal to the third threshold, the third release processing portion 98 may release regulation on the removal of the toner container 51A imposed by the lock device 63A, regardless of whether or not the specific operation has been performed.

Here, when the storage amount of toner in the housing 31 of the development portion 23A exceeds the third threshold, the acquisition processing portion 94 acquires the expected amount of toner to be used. On the other hand, when the storage amount of toner in the housing 31 of the development portion 23A is less than or equal to the third threshold, the acquisition processing portion 94 does not acquire the expected amount of toner to be used.

The first control portion 7 may not include the authentication processing portion 91. The first control portion 7 may not include the notification processing portion 97. The first control portion 7 may not include the third release processing portion 98.

[Regulation Releasing Process]

Figure 8:
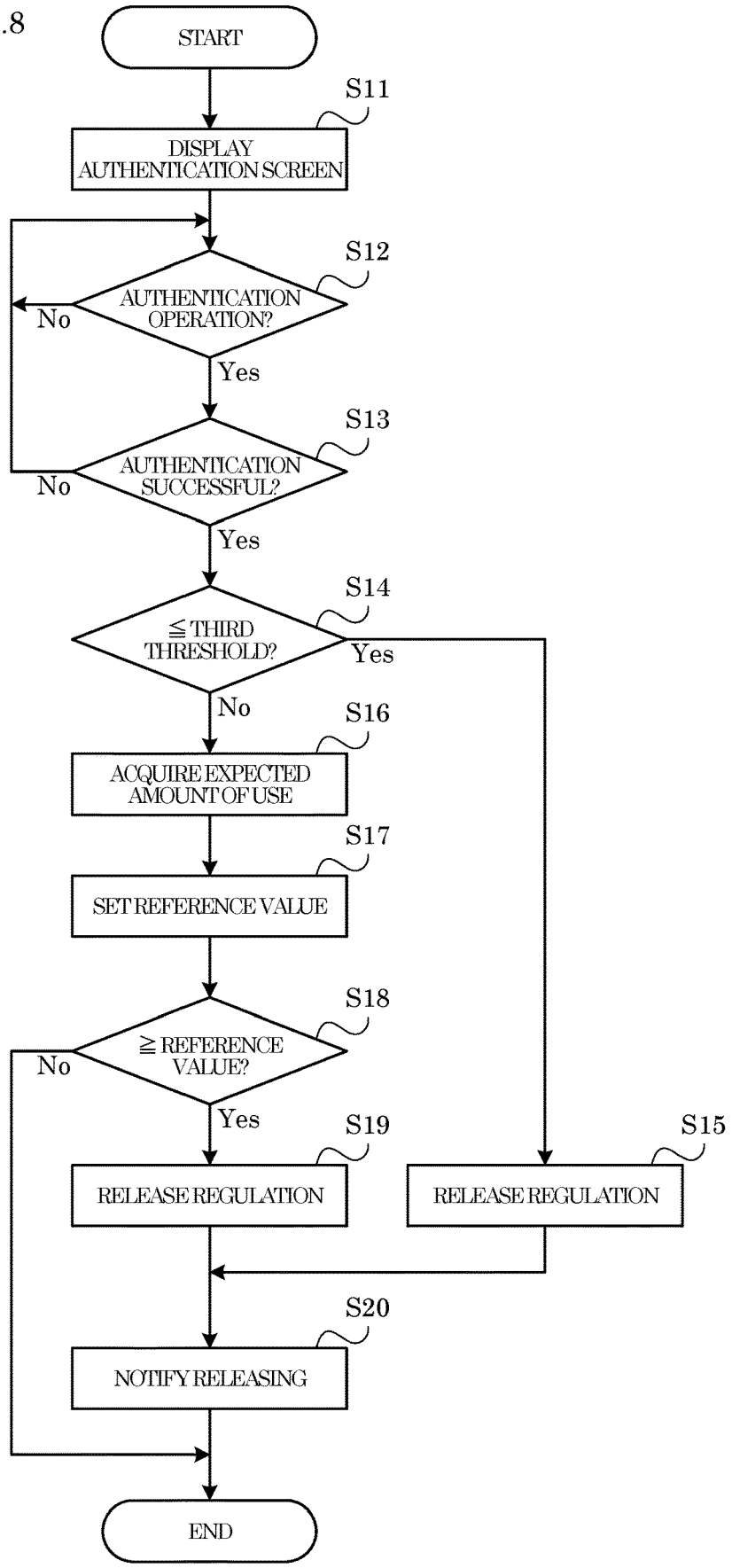
FIG. 8 is a flowchart showing one example of a regulation releasing process executed in the image forming apparatus according to the embodiment of the present disclosure.

The following describes an example of the procedure of a regulation releasing process executed by the first control portion 7 in the image forming apparatus 100, as well as a regulation releasing method of the present disclosure, with reference to FIG. 8. Here, steps S11, S12 . . . represent the reference number of process procedures (steps) executed by the first control portion 7. The regulation releasing process is executed when the call operation is executed.

<Step S11>

Firstly, in step S11, the first control portion 7 displays the authentication screen on the operation/display portion 5.

<Step S12>

In step S12, the first control portion 7 determines whether or not the authentication operation has been performed on the authentication screen displayed in step S11.

Here, upon determining that the authentication operation has been performed (Yes in step S12), the first control portion 7 shifts the process to step S13. Upon determining that the authentication operation is not executed (No in step S12), the first control portion 7 waits for the authentication operation to be performed in step S12.

<Step S13>

In step S13, the first control portion 7 determines whether or not authentication of the user based on the authentication operation is successful. Here, the processes from step S11 to step S13 are executed by the authentication processing portion 91 of the first control portion 7.

Here, upon determining that authentication of the user is successful (Yes in step S13), the first control portion 7 shifts the process to step S14. In addition, upon determining that authentication of the user is not successful (No in step S13), the first control portion 7 shifts the process to step S12.

The processes from step S 11 to step S13 may be omitted. In this case, the regulation releasing process may be executed in, for example, a timing when the power of the image forming apparatus 100 is turned on, or in a timing when the operation mode in the image forming apparatus 100 is changed from a power saving mode in which power consumption is lower than the normal mode to the normal mode.

<Step S14>

In step S14, the first control portion 7 determines whether or not the storage amount of toner in the housing 31 of the development portion 23A is less than or equal to the third threshold.

For example, the first control portion 7 determines whether or not the latest storage amount of toner in the housing 31 of the development portion 23A, which is acquired in the printing process executed immediately before, is less than or equal to the third threshold.

Here, upon determining that the storage amount of toner in the housing 31 of the development portion 23A is less than or equal to the third threshold (Yes in step S14), the first control portion 7 shifts the process to step S15. In addition, upon determining that the storage amount of toner in the housing 31 of the development portion 23A is not less than or equal to the third threshold (No in step S14), the first control portion 7 shifts the process to step S16.

<Step S15>

In step S15, the first control portion 7 releases regulation on the removal of the toner container 51A imposed by the lock device 63A. Here, the processes of step S14 and step S15 are executed by the third release processing portion 98 of the first control portion 7.

For example, the first control portion 7 waits for the specific operation to be performed by the user. When the specific operation performed by the user is detected, the first control portion 7 releases regulation on the removal of the toner container 51A imposed by the lock device 63A.

<Step S16>

In step S16, the first control portion 7 acquires the expected amount of toner to be used by the authenticated user. Here, the process of step S16 is an example of an acquisition step of the present disclosure, and is executed by the acquisition processing portion 94 of the first control portion 7.

For example, the first control portion 7 acquires the expected amount of toner to be used by the authenticated user, based on the print history of the authenticated user. For example, the first control portion 7 acquires the average value of the amount of toner used for each execution timing of the printing process in the predetermined specific period (the average value of the amount of toner used per one printing process), as the expected amount of toner to be used by the authenticated user.

<Step S17>

In step S17, the first control portion 7 sets the reference value. Here, the process of step S17 is executed by the setting processing portion 95 of the first control portion 7.

For example, when the temperature detected by the temperature sensor 20 exceeds the reference temperature, the first control portion 7 sets the remaining amount of toner in the toner container 51A as the reference value. In addition, when the temperature detected by the temperature sensor 20 is less than or equal to the reference temperature, the first control portion 7 sets the multiplication result of the remaining amount of toner in the toner container 51A and the coefficient, as the reference value.

With the above-described configuration, in a case where the printing operation is stopped before the remaining amount of toner inside the toner container 51A becomes empty due to decrease in fluidity of the toner inside the toner container 51A caused by decreased internal temperature of the housing 9, it is possible to reflect the remaining amount of toner inside the toner container 51A at a time of stopping the printing operation to the reference value.

<Step S18>

In step S18, the first control portion 7 determines whether or not the expected amount of toner to be used acquired in step S16 is greater than or equal to the reference value set in step S17.

Here, upon determining that the expected amount of toner to be used acquired in step S16 is greater than or equal to the reference value set in step S17 (Yes in step S18), the first control portion 7 shifts the process to step S19. In addition, upon determining that the expected amount of toner to be used acquired in step S16 is not greater than or equal to the reference value set in step S17 (No in step S18), the first control portion 7 terminates the regulation releasing process.

<Step S19>

In step S19, the first control portion 7 releases regulation on the removal of the toner container 51A imposed by the lock device 63A. Here, the processes of step S18 and step S19 are an example of a second releasing step of the present disclosure, and are executed by the second release processing portion 96 of the first control portion 7.

For example, the first control portion 7 waits for the specific operation to be performed by the user. When the specific operation performed by the user is detected, the first control portion 7 releases regulation on the removal of the toner container 51A imposed by the lock device 63A.

<Step S20>

In step S20, the first control portion 7 notifies the user that the toner container 51A can be replaced. Here, the process of step S20 is executed by the notification processing portion 97 of the first control portion 7.

For example, the first control portion 7 displays, on the operation/display portion 5, the notification screen including the message indicating that the toner container 51A can be replaced.

The process of step S14 may be executed when it is determined in step S18 that the expected amount of toner to be used acquired in step S16 is not greater than or equal to the reference value set in step S17.

[Printing Control Process]

Figure 9:
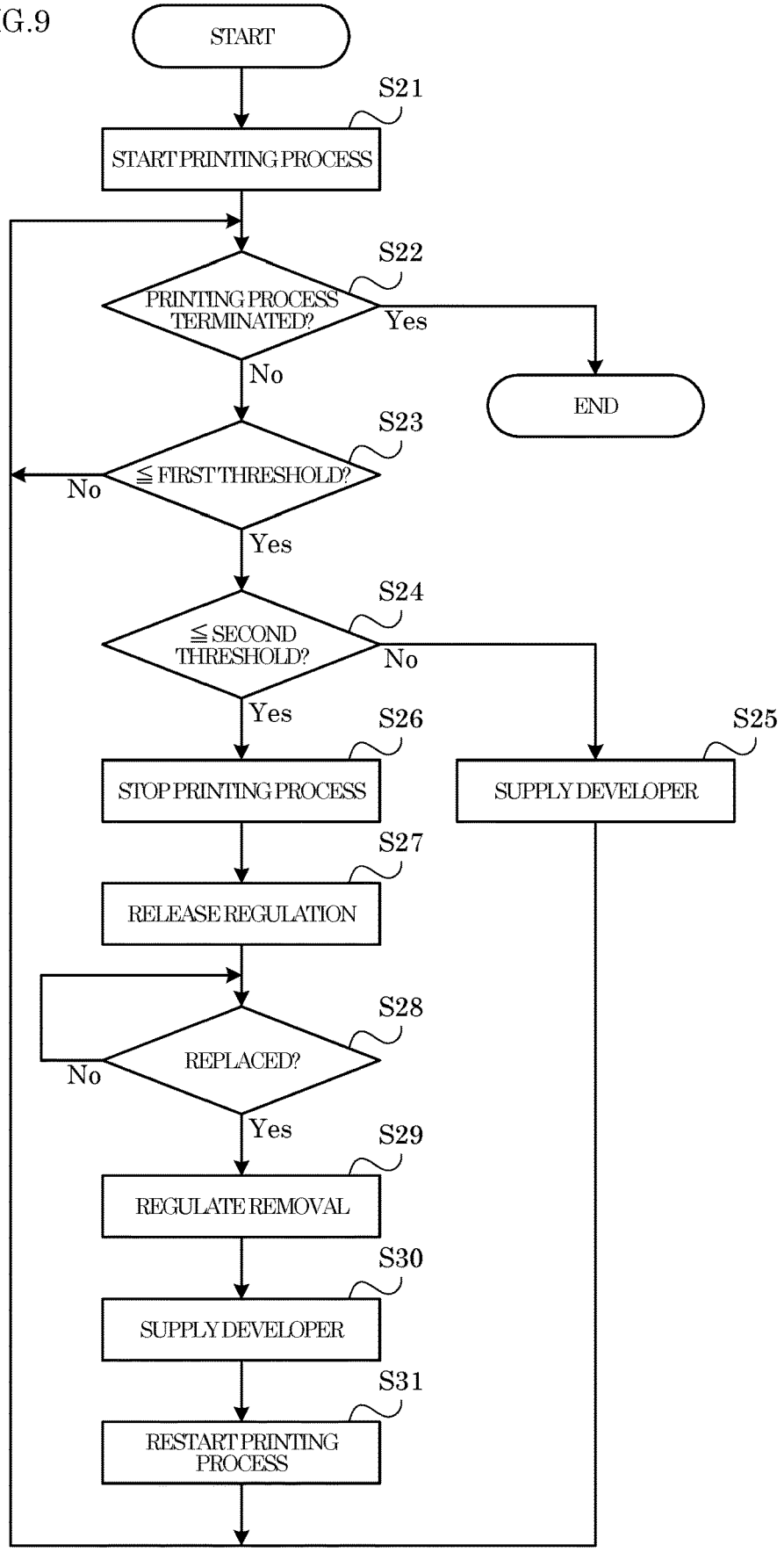
FIG. 9 is a flowchart showing one example of a printing control process that is executed in the image forming apparatus according to the embodiment of the present disclosure.

Next, the following describes an example of the procedure of a printing control process that is executed by the first control portion 7 of the image forming apparatus 100, with reference to FIG. 9. The printing control process is executed when a command to execute the printing process is input.

<Step S21>

In step S21, the first control portion 7 starts the printing process to be executed.

<Step S22>

In step S22, the first control portion 7 determines whether or not the printing process to be executed has been terminated.

Here, upon determining that the printing process to be executed has been terminated (Yes in step S22), the first control portion 7 terminates the printing control process. In addition, upon determining that the printing process to be executed has not been terminated (No in step S22), the first control portion 7 shifts the process to step S23.

<Step S23>

In step S23, the first control portion 7 determines whether or not the storage amount of toner in the housing 31 of the development portion 23A is less than or equal to the first threshold.

Here, upon determining that the storage amount of toner in the housing 31 of the development portion 23A is less than or equal to the first threshold (Yes in step S23), the first control portion 7 shifts the process to step S24. In addition, upon determining that the storage amount of toner in the housing 31 of the development portion 23A is not less than or equal to the first threshold (No in step S23), the first control portion 7 shifts the process to step S22. In this case, the first control portion 7 executes the process of step S13 in the determination cycle, until the printing process is terminated.

<Step S24>

In step S24, the first control portion 7 determines whether or not the storage amount of toner in the housing 31 of the development portion 23A is less than or equal to the second threshold.

Here, upon determining that the storage amount of toner in the housing 31 of the development portion 23A is less than or equal to the second threshold (Yes in step S24), the first control portion 7 shifts the process to step S26. In addition, upon determining that the storage amount of toner in the housing 31 of the development portion 23A is not less than or equal to the second threshold (No in step S24), the first control portion 7 shifts the process to step S25.

<Step S25>

In step S25, the first control portion 7 supplies the toner from the toner container 51A attached to the attachment portion 62A to the housing 31 of the development portion 23A. Here, the processes of step S23 and step S25 are executed by the supply processing portion 92 of the first control portion 7.

<Step S26>

In step S26, the first control portion 7 causes the printing process to be stopped.

<Step S27>

In step S27, the first control portion 7 releases regulation on the removal of the toner container 51A imposed by the lock device 63A. Here, the processes of step S24, step S26, and step S27 are executed by the first release processing portion 93 of the first control portion 7.

For example, the first control portion 7 waits for the specific operation to be performed by the user. When the specific operation performed by the user is detected, the first control portion 7 releases regulation on the removal of the toner container 51A imposed by the lock device 63A.

<Step S28>

In step S28, the first control portion 7 determines whether or not the toner container 51A has been replaced.

For example, when closing of the front cover 9A is detected by the open/close sensor 56 in a case where the toner container 51A is attached to the attachment portion 62A, the first control portion 7 determines that the toner container 51A has been replaced. The first control portion 7 may determine whether or not the toner container 51A is attached to the attachment portion 62A based on, for example, success or failure of acquisition of the specific data by the data acquisition portion 55 corresponding to the attachment portion 62A.

Here, upon determining that the toner container 51A has been replaced (Yes in step S28), the first control portion 7 shifts the process to step S29. In addition, upon determining that the toner container 51A has not been replaced (No in step S28), the first control portion 7 waits for replacement of the toner container 51A in step S28.

<Step S29>

In step S29, the first control portion 7 regulates the removal of the toner container 51A attached to the attachment portion 62A.

Specifically, the first control portion 7 regulates the removal of the toner container 51A attached to the attachment portion 62A by causing the power supply to the solenoid 74 of the lock device 63A to be stopped and causing the restriction member 72 of the lock device 63A to be moved from the releasing position to the lock position.

After starting the power supply to the solenoid 74 of the lock device 63A in step S27, the first control portion 7 may stop the power supply to the solenoid 74 after a predetermined time has elapsed. In this case, the engaged portion 71A of the lock cover 71 of the lock device 63A may be engaged with the engaging portion 72A of the restriction member 72 of the lock device 63A by snap-fitting, in accordance with the closing of the lock cover 71. In addition, the process of step S29 may be omitted.

<Step S30>

In step S30, the first control portion 7 supplies the toner from the toner container 51A attached to the attachment portion 62A to the housing 31 of the development portion 23A.

For example, the first control portion 7 supplies the toner from the toner container 51A to the housing 31 until the storage amount of toner in the housing 31 of the development portion 23A exceeds a predetermined fourth threshold higher than the second threshold.

<Step S31>

In step S31, the first control portion 7 restarts the printing process that was stopped in step S26.

As described above, in the image forming apparatus 100, when the expected amount of toner to be used by the user is acquired, and when the expected amount of toner to be used is greater than or equal to the reference value that is determined based on the remaining amount of toner in the toner container 51A, regulation on the removal of the toner container 51A imposed by the lock device 63A is released. This allows the user to replace the toner container 51A before printing, when it is determined that printing will be stopped due to the decrease in the remaining amount of toner. Therefore, it is possible to reduce the remaining amount of toner inside the toner container 51 at a time of replacement, and to avoid the stop of printing due to the decrease in the remaining amount of toner.

The present disclosure may be applied to an image forming apparatus that forms an image by other image forming methods such as an inkjet method.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an attachment portion to which a developer storing portion storing developer is attached;

a regulation portion that regulates a removal of the developer storing portion attached to the attachment portion from the attachment portion;

an image forming portion including a storing portion that stores the developer, the image forming portion configured to form an image by using the developer stored in the storing portion;

a supply processing portion that supplies the developer to the storing portion from the developer storing portion attached to the attachment portion, when a storage amount of the developer in the storing portion is less than or equal to a predetermined first threshold;

a first release processing portion that restricts operation of the image forming portion and releases regulation on the removal of the developer storing portion imposed by the regulation portion, when the storage amount of the developer in the storing portion is less than or equal to a second threshold, which is lower than the first threshold;

an acquisition processing portion that acquires an expected amount of developer to be used by a user; and a second release processing portion that releases regulation on the removal of the developer storing portion imposed by the regulation portion, when the expected amount of developer to be used acquired by the acquisition processing portion is greater than or equal to a predetermined reference value that is determined based on a remaining amount of the developer in the developer storing portion attached to the attachment portion.

2. The image forming apparatus according to claim 1, further comprising:

an authentication processing portion that authenticates the user, wherein the acquisition processing portion acquires the expected amount of developer to be used by the user, based on a print history of the user authenticated by the authentication processing portion.

3. The image forming apparatus according to claim 1, further comprising:

a setting processing portion that sets the reference value based on a remaining amount of the developer in the developer storing portion attached to the attachment portion and a temperature inside the image forming apparatus.

4. The image forming apparatus according to claim 1, further comprising:

a third release processing portion configured to release regulation on the removal of the developer storing portion imposed by the regulation portion, when the storage amount of the developer in the storing portion is less than or equal to a third threshold, which is lower than the first threshold and higher than the second threshold, wherein the acquisition processing portion acquires the expected amount of developer to be used, when the storage amount of the developer in the storing portion exceeds the third threshold.

5. The image forming apparatus according to claim 1, further comprising:

a notification processing portion that notifies the user that the developer storing portion can be replaced when the expected amount of developer to be used acquired by the acquisition processing portion is greater than or equal to the reference value.

6. A regulation releasing method that is executed in an image forming apparatus including an attachment portion to which a developer storing portion that stores developer is attached, a regulation portion that regulates a removal of the developer storing portion attached to the attachment portion from the attachment portion, and an image forming portion including a storing portion that stores the developer, the image forming portion configured to form an image by using the developer stored in the storing portion, the regulation releasing method comprising:

a supplying step of, when a storage amount of the developer in the storing portion is less than or equal to a predetermined first threshold, supplying the developer to the storing portion from the developer storing portion attached to the attachment portion;

a first releasing step of, when the storage amount of the developer in the storing portion is less than or equal to a second threshold, which is lower than the first threshold, restricting operation of the image forming portion and releasing regulation on the removal of the developer storing portion imposed by the regulation portion;

an acquisition step of acquiring an expected amount of developer to be used by a user; and a second releasing step of, when the expected amount of developer to be used acquired by the acquisition step is greater than or equal to a predetermined reference value that is determined based on a remaining amount of the developer in the developer storing portion attached to the attachment portion, releasing regulation on the removal of the developer storing portion imposed by the regulation portion.

* * * * *